US005775117A

United States Patent [19]

Shaw

[11] Patent Number: 5,775,117

[45] Date of Patent: Jul. 7, 1998

[54] VARIABLE CAPACITY VAPOR COMPRESSION COOLING SYSTEM

[76] Inventor: David N. Shaw, 200D Brittany Farms Rd., New Britain, Conn. 06053

[21] Appl. No.: 583,505

[22] Filed: Jan. 5, 1996

Related U.S. Application Data

[63] Continuation-in-part of Ser. No. 550,254, Oct. 30, 1995.

[51] Int. Cl.[6] ..... F25B 41/00; F01C 1/16

[52] U.S. Cl. ..... 62/196.3; 418/201.2

[58] Field of Search ..... 418/201.2; 62/196.3

[56] References Cited

U.S. PATENT DOCUMENTS 203,477 12/1878 Kimio et al. ..... 418/201.2

4,799,865 1/1989 Oscarsson ..... 418/201.2 X 4,946,362 8/1990 Soderlund et al. ..... 418/201.2

*Primary Examiner*—William E. Wayner

*Attorney, Agent, or Firm*—Fishman, Dionne, Cantor & Colburn

[57] ABSTRACT

A helical-screw rotary compressor having a twin rotor configuration or a multi-rotor (i.e., at least three) configuration with defined compressor induction and discharge ends has at least one unloader piston disposed at said compressor discharge end with an economizer injection port therein. The unloader pistons being opened and closed in fine discrete steps by microprocessor controlled stepping motors which drive linear actuators.

17 Claims, 4 Drawing Sheets

VARIABLE CAPACITY VAPOR COMPRESSION COOLING SYSTEM

This is a continuation-in-part of U.S. patent application Ser. No. 08/550,254 entitled: Variable Capacity Vapor Compression Cooling System filed on Oct. 30, 1995 by David N. Shaw.

BACKGROUND OF THE INVENTION

The present invention relates generally to systems for cooling. More specifically, the present invention relates to a variable capacity vapor compression cooling system.

Cooling systems in the HVAC (heating, ventilation and air conditioning) industry are well known. By way of example, a schematic diagram of a typical cooling system is shown in FIG. 1 herein, labeled prior art. Referring to FIG. 1 herein, water enters an evaporator 12 through an input 14 where it is circulated through tubes within the evaporator and exits through an output 16. Liquid phase refrigerant enters evaporator 12 at an input 20 and evaporated refrigerant is delivered to a compressor 22 (e.g., a helical twin screw type compressor, which are well known in the art). Compressed vapor phase refrigerant is passed through an oil separator 24 for removing oil picked up in compressor 22. Thereafter the compressed vapor phase refrigerant is presented to a water cooled condenser 26 to condense the refrigerant to the liquid phase which is used for cooling, as is well known in the art. It will also be appreciated that air cooled condensers are well known and such could be used in place of the aforementioned water cooled condenser. Thereafter, liquid phase refrigerant is presented to an economizer 28 where vapor phase refrigerant (it is well known that a small portion of the refrigerant will be vapor, i.e., flash gas) is drawn off and delivered directly to the compressor. The liquid phase refrigerant is presented to input 20 of evaporator 12, thereby completing the cycle. When capacity of such a system is to be varied, it is common to unload the compressor using a slide valve control system, however, this is both inefficient and invariably, seriously complicates the overall design/cost of the compressor.

SUMMARY OF THE INVENTION

The above-discussed and other drawbacks and deficiencies of the prior art are overcome or alleviated by the novel compressor unloading system of the present invention. In accordance with the present invention, a helical-screw rotary compressor having a twin rotor configuration or a multi-rotor (i.e., at least three) configuration with defined compressor induction and discharge ends has at least one unloader piston disposed at said compressor discharge end with an economizer injection port therein. The unloader pistons being opened and closed in fine discrete steps by microprocessor controlled stepping motors which drive linear actuators.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
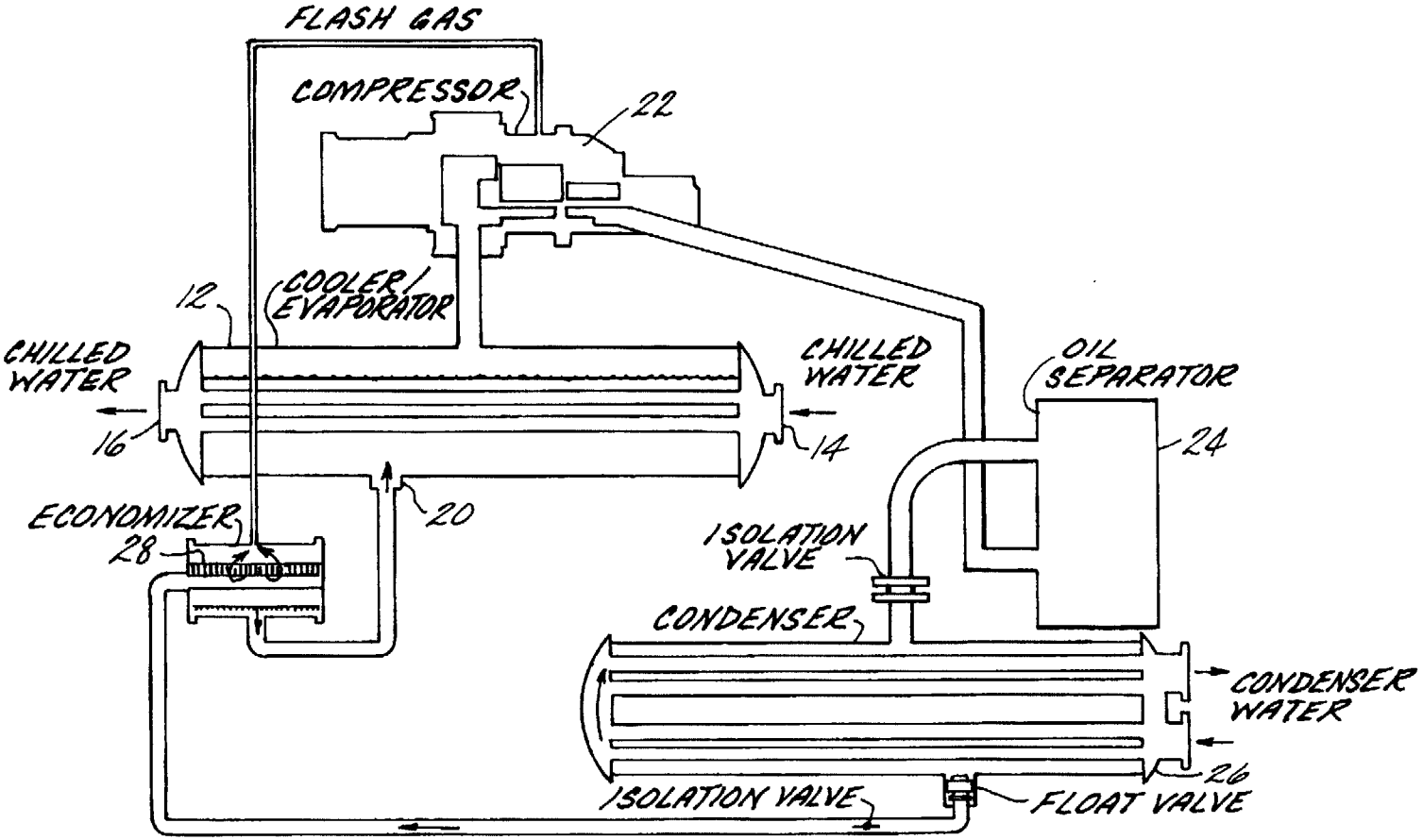
FIG. 1 (PRIOR ART)
FIG. 1 a schematic diagram a vapor compression cooling system in accordance with the prior art.
Figure 2:
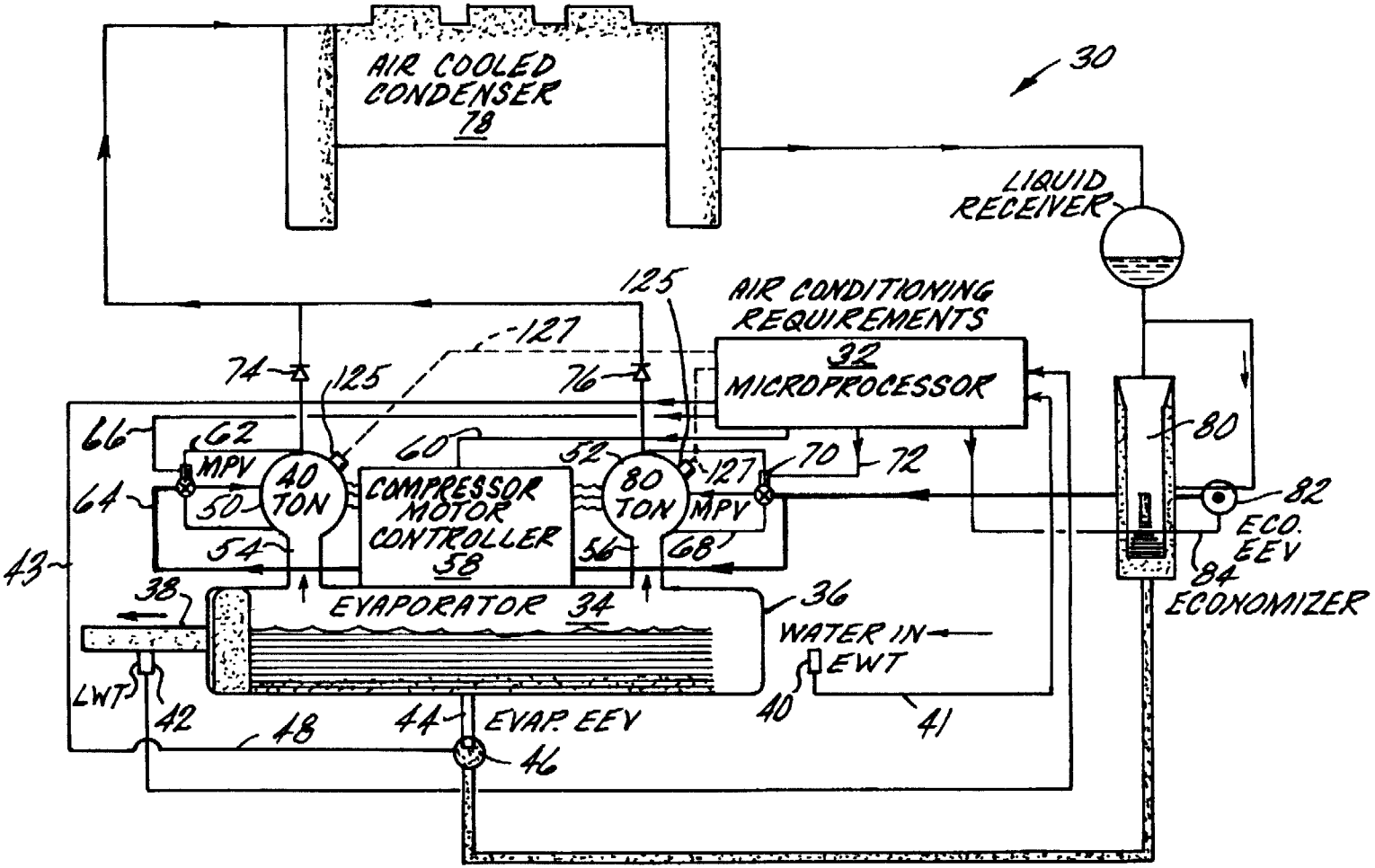
FIG. 2 is a schematic diagram of a variable capacity vapor compression cooling system in accordance with the present invention.

Referring to FIG. 2, a schematic diagram of a variable capacity vapor compression cooling system is generally shown at 30. In this example, air conditioning requirements are entered into a microprocessor 32 which controls system 30, as described below. Water enters an evaporator 34 through an input 36 where it is circulated through tubes within the evaporator and exits through an output 38. The entering water temperature is measured by a thermocouple 40 which sends a signal indicative of the entering water temperature to microprocessor 32, via a line 41. The exiting or leaving water temperature is measured by a thermocouple 42 which sends a signal indicative of the exiting water temperature to microprocessor 32, via a line 43. Although not shown the temperature of the water is regulated, with the temperature of the water being controlled by microprocessor 32 in response to the measured temperatures. The regulation of the water temperature allows control of the rate of evaporation of the liquid phase refrigerant in evaporator 34. Liquid phase refrigerant enters evaporator 34 at an input 44, with the rate of flow into evaporator 34 controlled by an electronic expansion valve 46, which is itself controlled by microprocessor 32 via a line 48. Evaporated refrigerant is delivered to first and second compressors 50 and 52, respectively, through outputs 54 and 56 of evaporator 34. In this example, compressor 50 has a forty ton capacity and compressor 52 has an eighty ton capacity. It will be appreciated that any suitable type of compressor may be employed and that system 30, e.g., a twin screw type compressor, a single screw type compressor or a multi-rotor compressor as described in co-pending U.S. patent application Ser. No. 08/550,253 entitled Multi-Rotor Compressor, by Shaw, which is incorporated herein by reference. The motors for compressors 50 and 52 are controlled by a controller 58 which is itself controlled by microprocessor 32, via a line 60. Compressor 50 has a feed back loop 62 attached thereto for feeding back some of the inducted vapor phase refrigerant. The amount of feed back in loop 62 is regulated by a multi-purpose valve 64 which is controlled by microprocessor 32, via a line 66. Compressor 52 has a feed back loop 68 attached thereto for feeding back some of the inducted vapor phase refrigerant. The amount of feed back in loop 68 is regulated by a multi-purpose valve 70 which is controlled by microprocessor 32, via a line 72.

Check valves 74 and 76 only allow flow of compressed vapor phase refrigerant from compressors 50 and 52 and prevent backflow thereinto. The compressed vapor phase refrigerant is then presented to an air cooled condenser 78, condensing the refrigerant to the liquid phase which is used for cooling, as is well known in the art. Thereafter, liquid phase refrigerant is presented to an economizer 80 where vapor phase refrigerant (it is well known that a small portion of the refrigerant will be vapor) is drawn off. The amount of vapor phase refrigerant drawn off is regulated by an electronic expansion valve 82 which is controlled by microprocessor 32, via a line 84. This vapor phase refrigerant is presented to multi-purpose valves 64 and 70 where it is directed to the respective compressors 50 and 52. The liquid phase refrigerant is delivered to input 44 of evaporator 34 with the flow thereof being regulated by an electronic expansion valve 46. Accordingly, the above describes a complete cycle which can be capacity varied without unloading of the compressors, as described more completely below.

The multi-purpose valves (MPV) 64 and 70 allow economizer generated vapor to flow into the compressors, serve to isolate the compressors from the economizer, allow fluid bypass from the compressors' economizer port to suction, and allow additional bypass from the compressors discharge to suction which facilitates an unloaded start of the compressors. Electronic expansion valve (EEV) 82 regulates the amount of vapor drawn off from the economizer. Electronic expansion valve 42 regulates the amount of liquid phase refrigerant into the evaporator from the economizer. Motor controller 58 turns on and off the motors of compressors 50 and 52. The capacity of the system of the present invention can be varied as indicated in the TABLE below.

TABLE

| Compressor being operated | Electronic expansion valve(s) turned down | Multi-purpose valve turned down | Turndown ratio | Capacity in tons |
|---|---|---|---|---|
| Forty ton compressor 50 | EEV 82 and 46 | MPV 64 and 70 | .17 | 20 |
| Forty ton compressor 50 | EEV 82 and 46 | | .23 | 27 |
| Forty ton compressor 50 | EEV 82 | | .28 | 34 |
| Forty ton compressor 50 | | | .33 | 40 |
| Eighty ton compressor 52 | EEV 82 and 46 | MPV 64 and 70 | .33 | 40 |
| Eighty ton compressor 52 | EEV 82 and 46 | | .43 | 51 |
| Eighty ton compressor 52 | EEV 82 | | .54 | 65 |
| Eighty ton compressor 52 | | | .67 | 80 |
| Forty and eighty ton compressors 50 and 52 | EEV 82 and 46 | | .58 | 69 |
| Forty and eighty ton compressors 50 and 52 | EEV 82 | | .73 | 88 |
| Forty and eighty ton compressors 50 and 52 | | | 1.00 | 120 |

It will be appreciated that the turndown ratio can be varied whereby different capacities can be obtained and the above TABLE is only exemplary. The microprocessor generates control signals which are presented to MPVs 64 and 70, EEVs 82 and 46, and controller 58 over the signal lines described above. These control signals are determined in response to system requirements which are processed in accordance with a schedule or algorithm stored in the microprocessor.

Figure 3:
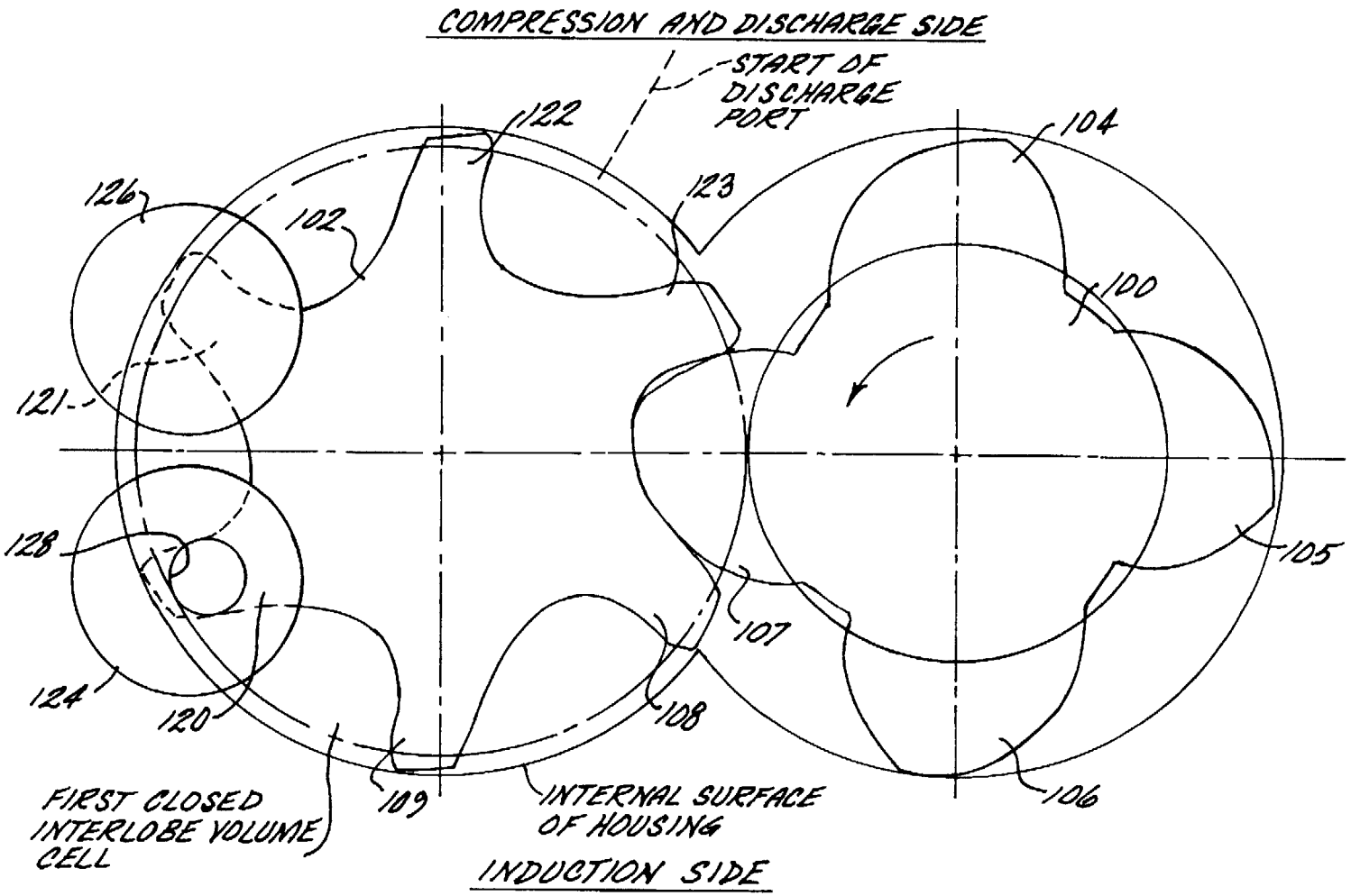
FIG. 3 is a discharge end view of a twin rotor assembly employing the unloading system of the present invention.

In accordance with the present invention, further unloading can be accomplished by unloading of the compressors using a novel efficient and relatively simple unloading system. Referring to FIG. 3, a discharge end view a twin rotor configuration used in a helical type compressor is generally shown. The twin rotor configuration comprises a male rotor 100 which drives an axially aligned female rotor 102. Male rotor 100 is driven by a motor, not shown, as is well known. Male rotor 100 has four lobes 104–107 with, e.g., a 300° wrap and female rotor 102 has six lobes 108–123 with, e.g., a 200° wrap. In accordance with this example, the compression-discharge phase of the axial sweep with respect to male rotor 100 occupies 300° of rotation, with the timing between the closed discharge port and the closed suction port occupying the remaining 60° of rotation. Unloader pistons 124 and 126 are positioned to stop at the discharge end face of the female rotor. When the pistons are off the discharge end face, vapor is pushed back to the induction side of the compressor instead of being compressed and then pushed out the discharge port. Pistons 124 and 126 are positioned on the discharge end face of the female rotor relative to the degree of interlobe volume reduction that has taken place before initial exposure to the unloader piston breakthrough area, such being well known in the art. In the prior art, the economizer injection port is located at the side of the compressor housing and is positioned along a portion of a helix line of a female lobe, downstream of the first closed interlobe volume. In accordance with the present invention, the economizer injection port 128 is located in piston 124, whereby economizer flow is automatically bypassed to suction when piston 124 is retracted. Economizer port 128 is preferably no wider than the female lobe, as is clearly shown in the FIGURE, whereby no interlobe bypass will occur when the compressor is fully loaded and peak isentropic efficiency is desired. It is an important feature of the present invention, that the economizer injection port is located in the unloader piston. Pistons 124 and 126 are preferably opened and closed in fine discrete steps by stepping motors 125, controlled by microprocessor 32 via lines 127, which drive linear actuators, e.g., ball screw type actuators. MPVs 64 and 70 are not required in system 30 when the above described unloading compressors are used. Further, compressor of equal size or a single compressor could be used in system 30 as a result of this added level of unloading control. The unloading system of the present invention provides a very broad range of modulating control at a low cost as compared to the prior art slide valve systems for controlling the pistons.

Figure 4:
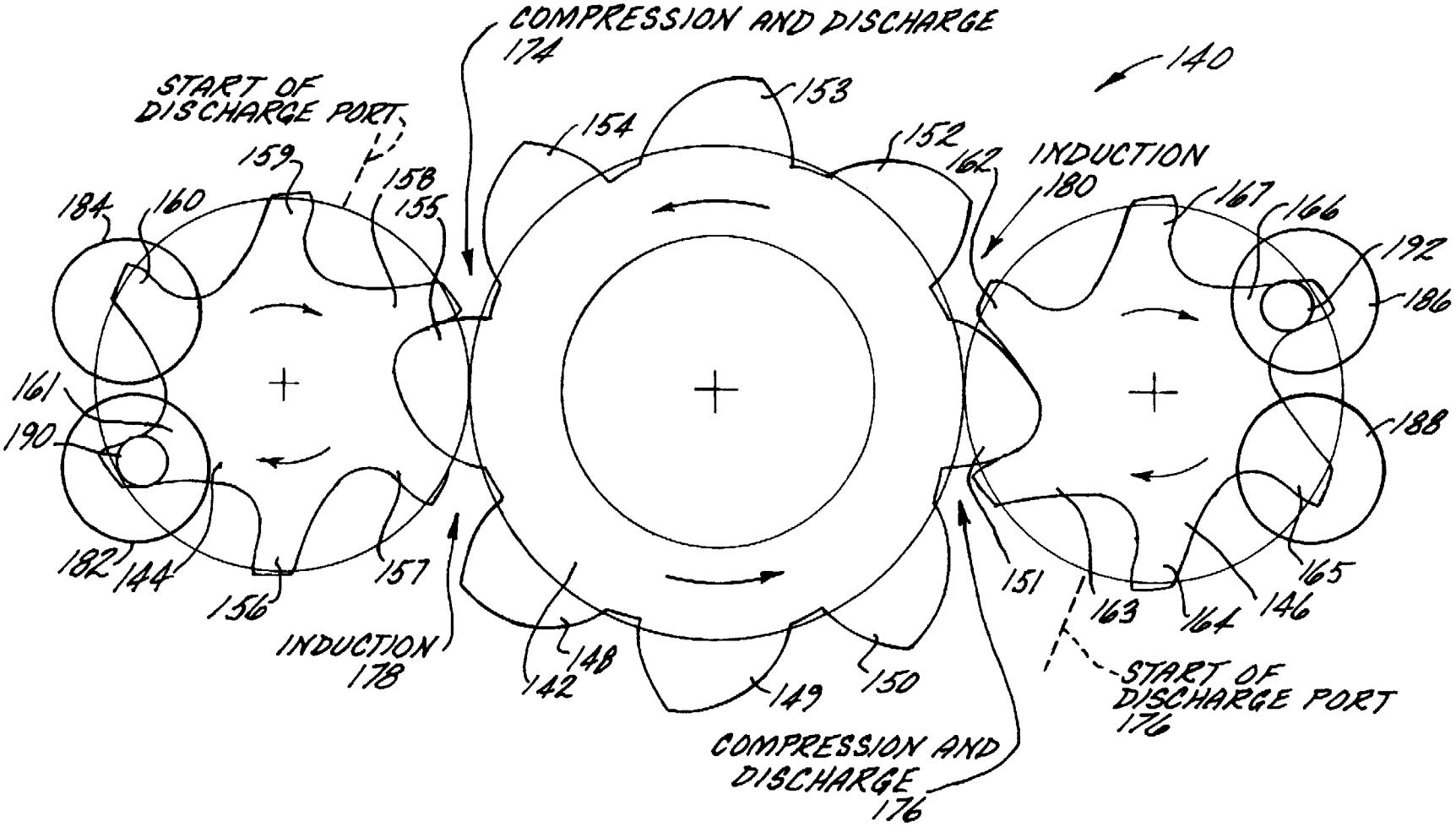
FIG. 4 is a discharge end view of a multi-rotor assembly employing the unloading system of the present invention.

Referring to FIG. 4, the compressor unloading system of the present invention may also be applied at the discharge end of the multi-rotor compressor 140 described in co-pending U.S. patent application Ser. No. 08/550,253 entitled Multi-Rotor Compressor, by Shaw. A male rotor 142 is axially aligned with and in communication with female rotors 144 and 146. Male rotor 142 is driven by a motor. In this example, male rotor 142 has eight lobes 148–155 with a 150° wrap, female rotor 144 has six lobes 156–161 with a 200° wrap, and female rotor 146 has six lobes 162–167 with a 200° wrap. Accordingly, the compression phase of the axial sweep with respect to male rotor 142 occupies 150° of rotation with the timing between the closed discharge ports 174, 176 and the closed suction ports 178, 180 occupying the remaining 30° of rotation. Duplicate processes are occurring simultaneously on the top and bottom of the male rotor. Unloader pistons 182 and 184 are positioned to stop at the discharge end face of female rotor 144 and unloader pistons 186 and 188 are positioned to stop at the discharge end face of female rotor 146. When the pistons are off the discharge end face, vapor is pushed back to the induction side of the compressor instead of being compressed and then pushed out the corresponding discharge port. Pistons 182 and 184 are positioned on the discharge end face of female rotor 144 relative to the degree of interlobe volume reduction that has taken place before initial exposure to the unloader piston breakthrough area for rotor 144 and pistons 186 and 188 are positioned on the discharge end face of female rotor 146 relative to the degree of interlobe volume reduction that has taken place before initial exposure to the unloader piston breakthrough area for rotor 146. In accordance with the present invention, an economizer injection port 190 is located in piston 182, whereby economizer flow is automatically bypassed to suction when piston 182 is retracted, and an economizer injection port 192 is located in piston 186, whereby economizer flow is automatically bypassed to suction when piston 186 is retracted. Economizer ports 190 and 192 are preferably no wider than the corresponding female lobe, as is clearly shown in the FIGURE, whereby no interlobe bypass will occur when the compressor is fully loaded and peak isentropic efficiency is desired. It is an important feature of the present invention, that the economizer injection ports are located in the unloader pistons. Pistons 182, 184, 186 and 188 are preferably opened and closed in fine discrete steps by stepping motors, controlled by microprocessor 32, which drive linear actuators, e.g., ball screw type actuators. Although not required, it is preferred that the unloader pistons oat each of the female rotors be operated in unison by the stepper motors.

As described in U.S. patent application Ser. No. 08/550,253, the rotors may have a different number of lobes than described above with out departing from the spirit and scope of the present invention. Further, while the above described embodiment has been described with only two female rotors, it is within the scope of the present invention that two or more female rotors may be employed with a single drive male rotor.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A helical-screw rotary compressor comprising:

a first rotor;

a second rotor axially aligned with said first rotor, said first rotor in communication with said second rotor whereby said first rotor drives said second rotor, said first and second rotors defining a compressor induction end and a compressor discharge end;

an unloader piston disposed at said compressor discharge end of one of said first and second rotors; and an economizer injection port in said unloader piston.

2. The compressor of claim 1 wherein:

said first rotor comprises a male rotor including a plurality of lobes with a degree of wrap; and said second rotor comprises a female rotor having a plurality of lobes with a degree of wrap.

3. The compressor of claim 1 wherein said economizer injection port has a width that is less than or equal to a width of one of said lobes of one of said first and second rotors at which said unloader piston is disposed, whereby interlobe bypass is avoided.

4. The compressor of claim 1 further comprising:

a stepper motor for driving said unloader piston between and open position and a closed position to achieve a desired unloading of said compressor.

5. A helical-screw rotary compressor comprising:

a first rotor;

at least two second rotors axially aligned with said first rotor, said first rotor in communication with said second rotors whereby said first rotor drives said second rotors, said first and each of said second rotors defining a corresponding compressor induction end and a corresponding compressor discharge end;

an unloader piston disposed at said compressor discharge end of each of said second rotors; and an economizer injection port in each of said unloader pistons.

6. The compressor of claim 5 wherein:

said first rotor comprises a male rotor including a plurality of lobes with a degree of wrap; and said at least two second rotors comprises at least two female rotors, each of said female rotors having a plurality of lobes with a degree of wrap.

7. The compressor of claim 6 wherein said at least two female rotors comprises two female rotors.

8. The compressor of claim 6 wherein said at least two female rotors comprises three female rotors.

9. The compressor of claim 5 wherein each of said economizer injection ports has a width that is less than or equal to a width of one of said lobes of said corresponding second rotors, whereby interlobe bypass is avoided.

10. The compressor of claim 5 further comprising:

a stepper motor for driving each of said unloader pistons between and open position and a closed position to achieve a desired unloading of said compressor.

11. The compressor of claim 10 wherein said stepper motors are synchronized to drive said unloader pistons in unison.

12. A helical-screw rotary compressor having first and second rotors defining a compressor induction end and a compressor discharge end with an unloader piston disposed at said compressor discharge end of one of said first and second rotors, wherein the improvement comprises:

an economizer injection port in said unloader piston.

13. The compressor of claim 12 wherein said economizer injection port has a width that is less than or equal to a width of one of a plurality of lobes of one of said first and second rotors at which said unloader piston is disposed, whereby interlobe bypass is avoided.

14. A variable capacity cooling system comprising:

an evaporator receptive to liquid phase refrigerant, said evaporator for evaporating the liquid phase refrigerant to provide vapor phase refrigerant;

a compressor receptive to the vapor phase refrigerant from said evaporator, said compressor for compressing the vapor phase refrigerant to provide compressed vapor phase refrigerant, said compressor comprising, (1) first and second rotors defining a compressor induction end and a compressor discharge end, (2) an unloader piston disposed at said compressor discharge end of one of said first and second rotors, and (3) an economizer injection port in said unloader piston; a condenser receptive to the compressed vapor phase refrigerant from said compressor, said condenser for condensing the compressed vapor phase refrigerant to provide the liquid phase refrigerant;

an economizer receptive to the liquid phase refrigerant from said condenser, said evaporator receiving the liquid phase refrigerant from said economizer, said economizer containing vapor phase refrigerant associated with the liquid phase refrigerant from said condenser, said economizer for delivering the vapor phase refrigerant to said economizer injection port of said compressor, whereby actuation of said unloader piston varies capacity of said system.

15. The system of claim 14 wherein said economizer injection port has a width that is less than or equal to a width of one of a plurality of lobes of one of said first and second rotors at which said unloader piston is disposed, whereby interlobe bypass is avoided.

16. The system of claim 14 wherein said compressor further comprises:

a stepper motor for driving said unloader piston between and open position and a closed position to achieve a desired unloading of said compressor.

17. The system of claim 16 further comprising:

a processor for generating a control signal in response to cooling requirements, said control signal for actuating said stepper motor.

* * * * *